United States Patent [19]

York

[11] 4,258,439

[45] Mar. 31, 1981

[54] CONVERTIBLE GARMENT

[75] Inventor: Judd York, Clover, S.C.

[73] Assignee: Countess York Limited, Kings Mountain, N.C.

[21] Appl. No.: 69,916

[22] Filed: Aug. 27, 1979

[51] Int. Cl.[3] ..... A41D 5/00; A41D 3/08

[52] U.S. Cl. ..... 2/69.5; 2/88

[58] Field of Search ..... 2/69.5, 69, 88; 5/334 C

[56] References Cited

U.S. PATENT DOCUMENTS

| | | | |
|---|---|---|---|
| 2,701,885 | 2/1955 | Turco | 2/69.5 |
| 4,142,264 | 3/1979 | Whiting | 2/69.5 |

*Primary Examiner*—Doris L. Troutman

*Attorney, Agent, or Firm*—Diller, Ramik & Wight

[57] ABSTRACT

This disclosure relates to a convertible garment capable of being utilized as a blanket, a cape, and a lap robe having a foot pocket, the garment including a generally rectangular shaped piece of material having first and second opposite parallel edges and third and fourth opposite parallel edges, cooperative snap securing means along a first edge portion of the first and second edges, respectively, for forming a foot pocket upon the folding of the piece of material along a line generally parallel to the third and fourth edges, and third snap securing means along a second edge portion of one of the first and second edges for selective releasable securement to one of the first and second snap securing means for forming a cape upon the folding of the third and fourth edges toward a midline therebetween.

19 Claims, 5 Drawing Figures

FIG.3
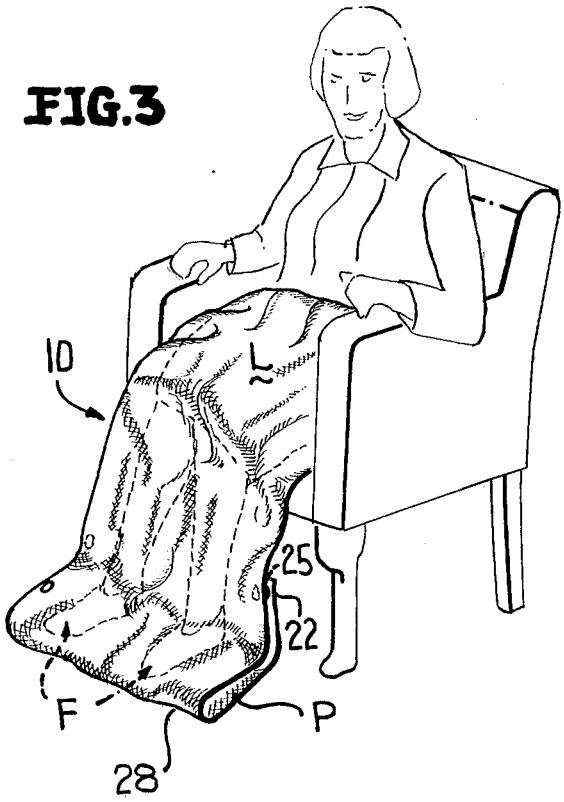
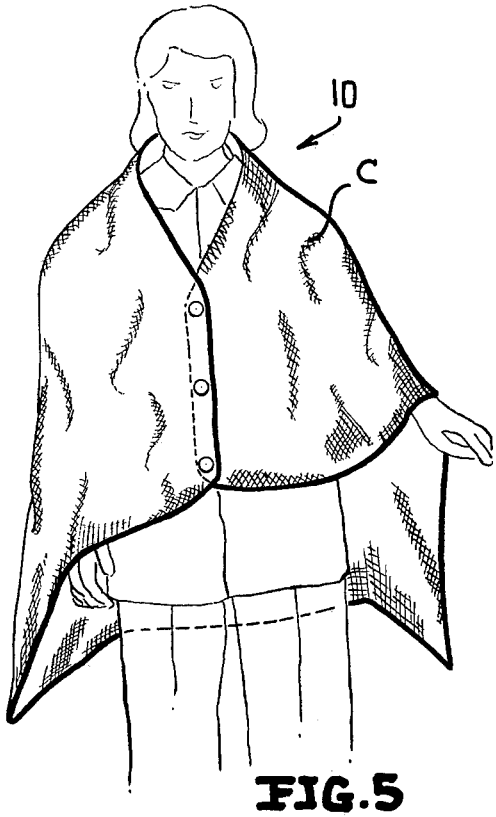
FIG.5
FIG.4
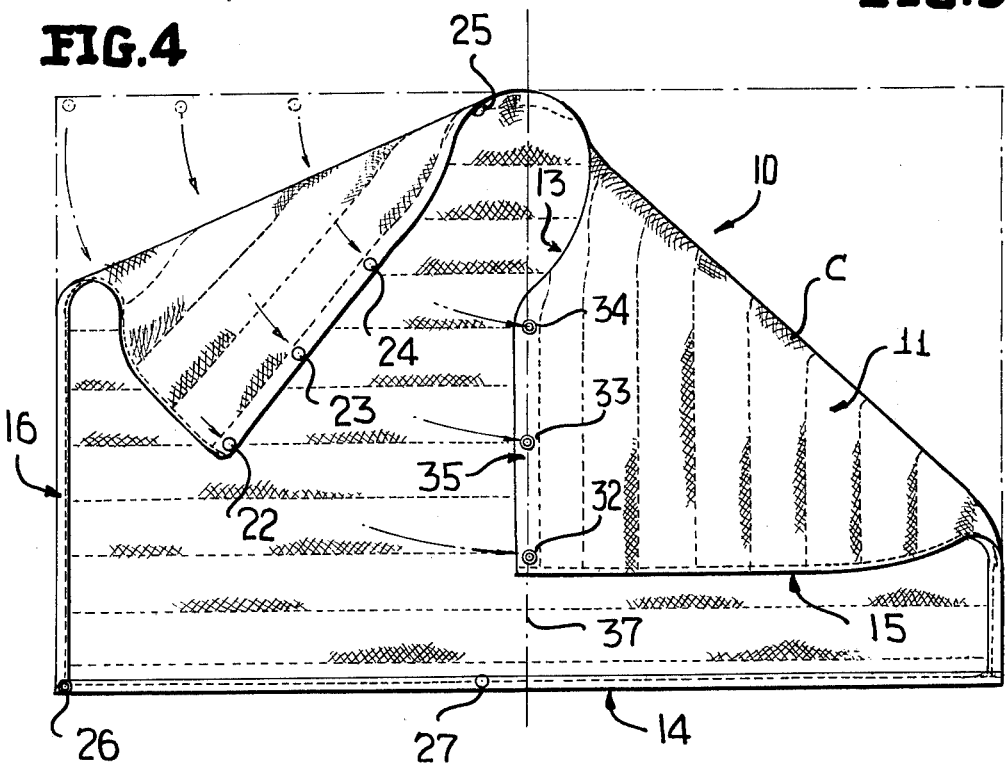

CONVERTIBLE GARMENT

A primary object of this invention is to provide a novel garment which is convertible from a generally rectangular configuration at which time it may serve simply as a blanket into a cape or a lap robe with the latter having a pocket for receiving the feet of a wearer.

A further object of this invention is to provide a novel convertible garment of the type latter described in which the garment is preferably of a polygonal or rectantular configuration having first and second opposite generally parallel edges and third and fourth opposite general parallel edges with cooperative first and second releasable securing means along a first edge portion of the first and second edges, respectively, for forming a foot pocket upon the folding of the piece of material along a line generally parallel to the third and fourth edges, and third releasable securing means along a second edge portion of one of the first and second edges for selective releasable securement to one of the cooperative first and second releasable securing means for forming a cape upon the folding of the third and fourth edges toward a midline therebetween.

Yet another object of this invention is to provide a novel convertible garment of the type heretofore set forth wherein the securing means are releasable snap fasteners with the snap fasteners of the first and second releasable securing means being securable to themselves to form the foot pocket and at least some of the snap fasteners of the first and third securing means being securable to each other to form the cape.

Still another object of this invention is to provide a novel convertible garment of the type herein described wherein the cooperative first releasable securing means and the third releasable securing means are disposed at first and second edge portions of the first edge, the first and second edge portions of the first edge are at opposite sides of the midline, and the first and second releasable securing means each include a fastener at opposite sides of the line along which the piece of material is folded to form the foot pocket.

With the above and other objects in view that will hereinafter appear, the nature of the invention will be more clearly understood by reference to the following detailed description, the appended claims and the several views illustrated in the accompanying drawings.

IN THE DRAWINGS

FIG. 3 is a perspective view, and illustrates the convertible garment being utilized as a lap robe with a pocket receiving the feet of a user.

FIG. 4 is a front elevational view of the convertible garment and illustrates the same partially folded to form a cape therefrom.

FIG. 5 is a perspective view and illustrates the manner in which the cape is worn by a user.

Figure 1:
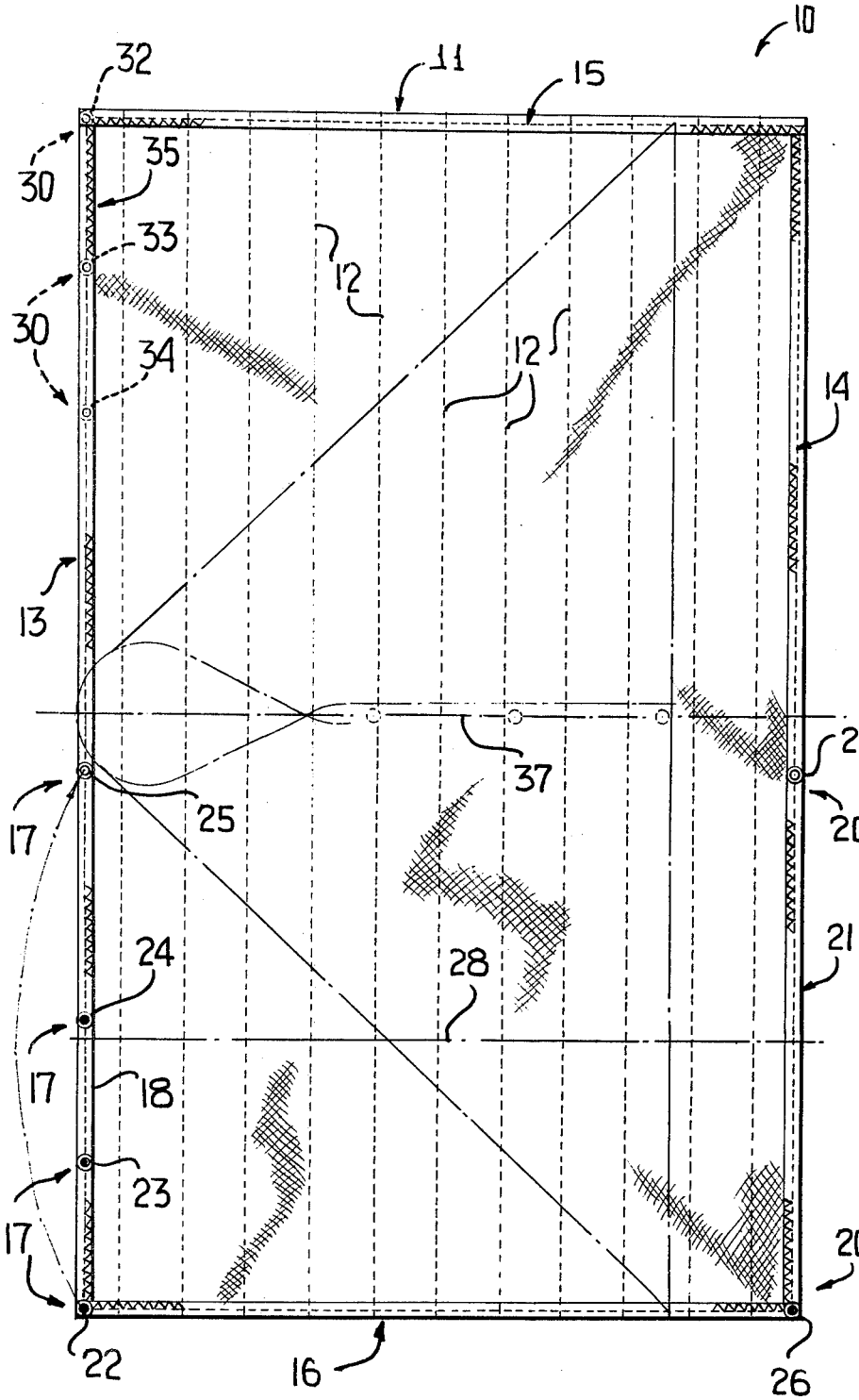
FIG. 1 is a top plan view of a piece of material with the inside uppermost, and illustrates a plurality of releasable male and female snap fasteners along edges of the piece of material which can be selectively secured to each other to form a pocket for the feet of the user, as shown in FIG. 3, and a cape as shown in FIGS. 4 and 5.

A novel convertible garment constructed in accordance with this invention is generally designated by the reference numeral 10, and is designed to be utilized simply as a blanket (FIG. 1) or as a cape (FIG. 5) or as a lap robe having a foot pocket (FIG. 3). The convertible garment 10 is generally of a polygonal or rectangular shape and initially is simply a blank or piece of material 11 which is preferably, though not necessarily, of a quilted constructed having three plys (not shown) provided with suitable parallel stitching 12 and bordering stitched hems (unnumbered). The blank 11 includes first and second opposite generally parallel edges 13, 14, respectively, and third and fourth opposite generally parallel edges 15, 16, respectively.

Cooperative first releasable securing means generally designated by the reference numeral 17 are located along a first edge portion 18 of the edge 13 and second cooperative releasable securing means generally designated by the reference numeral 20 are located along a first edge portion 21 of the edge 14 of the blank 11. The cooperative first releasable securing means 17 includes a plurality of upwardly opening female snap fasteners 22 through 24 and an upwardly projecting male fastener 25, as viewed in FIG. 1. The second cooperative releasable securing means includes an upwardly opening female snap fastener 26 and an upwardly projecting male snap fastener 27, again as viewed in FIG. 1.

In order to convert the convertible garment or blank 10 from its planar or polygonal or rectangular configuration (FIGS. 1 and 2) into a lap robe L (FIG. 3) having a foot pocket P, the fourth edge 16 is folded about a fold line or imaginary line 28 parallel to the edges 15, 16 and located approximately midway between the fasteners 22, 25 and 26, 27. Upon the folding of the edge 16 about the fold line 28, the snap fastener 22 is secured to the male counterpart 25 while the fastener 26 is secured to its male counterpart 27. In this manner the convertible garment or blank 10 may be utilized as a lap robe L (FIG. 3) to cover the lap of the person, the individual's legs, and the individual's feet F which are received in the pocket P.

Figure 2:
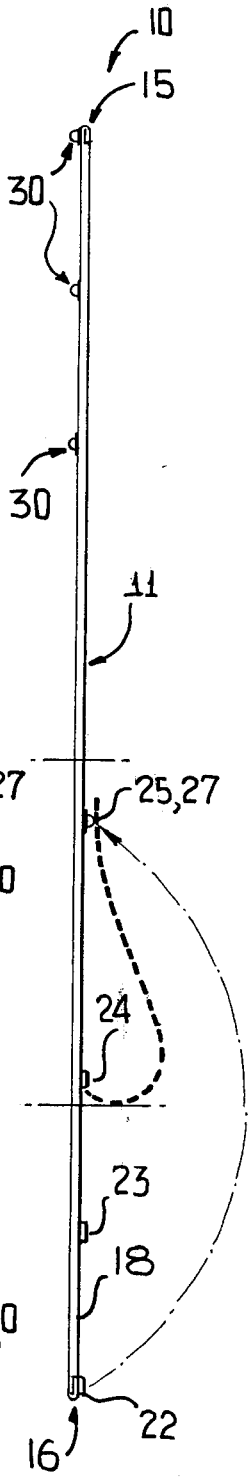
FIG. 2 is a side elevational view of the piece of material or blank of FIG. 1, and illustrates the disposition and location of several of the fasteners relative to the blank.

The blank 11 further includes third releasable securing means generally designated by the reference numeral 30 which are defined by three male snap fasteners 32 through 34 disposed along a second edge portion 35 of the edge 13 and projecting downwardly as viewed in FIG. 1.

The distance between the snap fasteners 32, 33 and 33, 34 corresponds to the distances between the snap fasteners 22, 23 and 23, 24, respectively. Furthermore, the snap fasteners 32 through 34 are spaced the same distances from a midline or fold line 37, as are the distances therefrom of the snap fasteners 22, 23 and 24. Furthermore, the midline or fold line 37 is approximately midway between and parallel to the edges 15, 16 of the blank 11.

In order to convert the blank 11 from its rectangular configuration (FIG. 1) into a cape C (FIGS. 4 and 5), the second edge portion 35 of the first edge 13 is folded toward the midline 37 between the edges 15, 16 which brings the male fasteners 32 through 34 into a position opening upwardly or outwardly of the garment or cape C, as is best illustrated in FIG. 4. Thereafter, the first edge portion 18 of the first edge 13 is likewise folded toward the midline 37 at which point the fasteners 22 through 24 can be snap secured to the fasteners 32 through 34, resulting in the cape C which is worn by an individual in the manner shown in FIG. 5.

From the foregoing, it is readily apparent that upon selectively utilizing the fasteners 22, 25 and 26, 27 the blank 11 is relatively rapidly converted into the lap robe L with the foot pocket P, and similarly by utilizing the fasteners 22 through 24 and the fasteners 32 through 34, the blank 11 or the lap robe L can be readily converted into the cape C.

Although only a preferred embodiment of the invention has been specifically illustrated and described herein, it is to be understood that minor variations may be made in the apparatus without departing from the spirit and scope of the invention, as defined in the appended claims.

I claim:

1. A convertible garment capable of being utilized as a cape or a lap robe having a foot pocket comprising a generally polygonally shaped piece of material having first and second opposite generally parallel edges and third and fourth opposite generally parallel edges, cooperative first and second releasable securing means along a first edge portion of said first and second edges, respectively, for forming a foot pocket upon the folding of the piece of material along a line generally parallel to said third and fourth edges, and third releasable securing means along a second edge portion of one of said first and second edges for alternative and selective releasable securement to one of said cooperative first and second releasable securing means for forming a cape upon the folding of said third and fourth edges toward a midline therebetween.

2. The convertible garment as defined in claim 1 wherein said cooperative first releasable securing means and said third releasable securing means are disposed at the first and second edge portions of said first edge.

3. The convertible garment as defined in claim 1 wherein said cooperative first releasable securing means and said third releasable securing means are disposed at the first and second edge portions of said first edge, and said first and second edge portions of said first edge are at opposite sides of said midline.

4. The convertible garment as defined in claim 2 wherein said cooperative first releasable securing means is at least in part securable to itself for forming said foot pocket, and said cooperative first releasable securing means is at least in part securable to at least a part of said third releasable securing means for forming said cape.

5. The convertible garment as defined in claim 2 wherein said cooperative first and second releasable securing means each include a fastener at opposite sides of said first-mentioned line.

6. The convertible garment as defined in claim 2 wherein said cooperative first and second releasable securing means each include a fastener at opposite sides of said first-mentioned line, and said fastener of said cooperative first releasable securing means are spaced from each other a distance corresponding generally to the distance between said fasteners of said cooperative second releasable securing means whereby said foot pocket is of a generally uniform size at least at said first and second edges.

7. The convertible garment as defined in claim 2 wherein said cooperative first and second releasable securing means each include a fastener at opposite sides of said first-mentioned line, one of said fasteners is disposed generally at a corner portion of said piece of material defined by said first and fourth edges, and said third releasable securing means includes a fastener at a corner portion of said piece of material defined by said first and third edges and being adapted for securement to said one fastener for forming said cape.

8. The convertible garment as defined in claim 2 wherein said piece of material has opposite sides, said cooperative first and second releasable securing means being operative upon the folding of said piece of material about said first-mentioned line to bring portions of a first of said opposite sides into opposing relationship, and said cooperative first and third releasable securing means being operative upon the folding of said piece of material toward said midline to bring portions of said opposite sides into opposing relationship.

9. The convertible garment as defined in claim 2 wherein said first, second and third releasable securing means include at least one male snap fastener.

10. The convertible garment as defined in claim 2 wherein said cooperative first and second releasable securing means each include at least one male and female snap fastener.

11. The convertible garment as defined in claim 2 wherein said cooperative first and second releasable securing means each include at least one male and female snap fastener, and said third releasable securing means include at least one male snap fastener.

12. The convertible garment as defined in claim 8 wherein said cooperative first releasable securing means is at least in part securable to itself for forming said foot pocket, and said cooperative first releasable securing means is at least in part securable to at least a part of said third releasable securing means for forming said cape.

13. The convertible garment as defined in claim 8 wherein said cooperative first and second releasable securing means each include a fastener at opposite sides of said first-mentioned line.

14. The convertible garment as defined in claim 8 wherein said cooperative first and second releasable securing means each include a fastener at opposite sides of said first-mentioned line, and said fasteners of said cooperative first releasable securing means are spaced from each other a distance corresponding generally to the distance between said fasteners of said cooperative second releasable securing means whereby said foot pocket is of a generally uniform size at least at said first and second edges.

15. The convertible garment as defined in claim 8 wherein said cooperative first and second releasable securing means each include a fastener at opposite sides of said first-mentioned line, one of said fasteners is disposed generally at a corner portion of said piece of material defined by said first and fourth edges, and said third releasable securing means includes a fastener at a corner portion of said piece of material defined by said first and third edges and being adapted for securement to said one fastener for forming said cape.

16. A convertible garment capable of being utilized as a cape or a lap robe having a foot pocket comprising a generally polygonally shaped piece of material having first and second opposite generally parallel edges and third and fourth opposite generally parallel edges, cooperative first and second releasable securing means along a first edge portion of said first and second edges, respectively, for forming a foot pocket upon the folding of the piece of material along a line generally parallel to said third and fourth edges, and third releasable securing means along a second edge portion of one of said first and second edges for alternative and selective releasable securement to fourth releasable securing means at said first edge portion of said one edge for forming a cape upon the folding of said third and fourth edges toward a midline therebetween.

17. The convertible garment as defined in claim 16 wherein said cooperative fourth releasable securing means in part defines one of said first and second releasable securing means.

18. The convertible garment as defined in claim 17 wherein siad cooperative first releasable securing means and said third releasable securing means are disposed at the first and second edge portions of said first edge, said fourth releasable securing means is disposed at said first edge portion of said first edge, said second releasable securing means is disposed at said first edge portion of said second edge, and said first and second edge portions of said first edge are at opposite sides of said midline.

19. The convertible garment as defined in claim 16 wherein said line generally parallel to said third and fourth edges and said midline are in generally parallel relationship to each other.

* * * * *